US008333460B2

(12) United States Patent
Morita

(10) Patent No.: US 8,333,460 B2
(45) Date of Patent: Dec. 18, 2012

(54) DROPLET EJECTING APPARATUS

(75) Inventor: Yoshitsugu Morita, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 344 days.

(21) Appl. No.: 12/798,074

(22) Filed: Mar. 29, 2010

(65) Prior Publication Data

US 2011/0050810 A1 Mar. 3, 2011

(30) Foreign Application Priority Data

Aug. 31, 2009 (JP) ..... 2009-199504

(51) Int. Cl.
*B41J 2/045* (2006.01)

(52) U.S. Cl. ..... 347/71; 347/68

(58) Field of Classification Search ..... None
See application file for complete search history.

(56) References Cited

U.S. PATENT DOCUMENTS

2009/0096844 A1 4/2009 Kojima et al.

FOREIGN PATENT DOCUMENTS

EP 2042322 A1 * 4/2009
JP 2009-096173 5/2009

* cited by examiner

*Primary Examiner* — Matthew Luu
*Assistant Examiner* — Erica Lin
(74) *Attorney, Agent, or Firm* — Frommer Lawrence & Haug LLP

(57) ABSTRACT

A droplet ejecting apparatus, including: a droplet ejecting head including a cavity unit with pressure chambers and a piezoelectric actuator; and a voltage application device, the actuator including: first active portions; second active portions; a first potential electrode which is constantly given a first potential by the voltage application device; a second potential electrode which includes second branch portions respectively corresponding to the second active portions and a second trunk portion that connects the second branch portions and which is constantly given a second potential different from the first potential by the voltage application device; and individual electrodes to each of which the first and second potentials are selectively given at a connection portion thereof by the voltage application device, wherein the connection portion is disposed so as to overlap the second trunk portion as seen in a superposition direction in which the cavity unit and the actuator are superposed.

12 Claims, 9 Drawing Sheets

☆ THERE ARE NO DEFORMING REGIONS ON COLUMNAR PORTION.
⇒NO PULL-UP EFFECT
⇒PROTRUDING DEFORMATION TOWARD PRESSURE CHAMBER IS NOT HINDERED.

☆ THERE ARE DEFORMING REGIONS ON COLUMNAR PORTION.
⇒PULL-UP EFFECT
⇒PULL-UP EFFECT IS PROMOTED.

☆ THERE ARE DEFORMING REGIONS ON COLUMNAR PORTION.
⇒PULL-UP EFFECT
⇒PROTRUDING DEFORMATION TOWARD PRESSURE CHAMBER IS HINDERED.

☆ THERE ARE NO DEFORMING REGIONS ON COLUMNAR PORTION.
⇒NO PULL-UP EFFECT

DROPLET EJECTING APPARATUS

CROSS REFERENCE TO RELATED APPLICATION

The present application claims priority from Japanese Patent Application No. 2009-199504, which was filed on Aug. 31, 2009, the disclosure of which is herein incorporated by reference in its entirety.

BACKGROUND OF THE INVENTION

1. Field of the Invention

The present invention relates to a droplet ejecting apparatus such as an ink-jet printer.

2. Discussion of Related Art

There has been conventionally known, as one example of a droplet ejecting apparatus, an ink-jet printer having: an ink-jet head which includes a cavity unit in which a plurality of pressure chambers are regularly formed and a piezoelectric actuator bonded to the cavity unit for permitting ink in each pressure chamber to be selectively ejected; and a voltage application device configured to apply a voltage to the piezoelectric actuator. As such a piezoelectric actuator, there are known one that utilizes a vertical effect actuator of a stacked or laminated type and one that utilizes a unimorph actuator.

In the ink-jet head of the ink-jet printer described above, there is a demand for increasing the density of the pressure chambers to ensure a high image quality and a high quality of recording by increasing the number of nozzles in the ink-jet head. Where the pressure chambers are arranged at a high density, however, the distance between adjacent pressure chambers is reduced, so that there is caused a problem of so-called crosstalk, during driving of the actuator, in which driving of one pressure chamber influences driving of another pressure chamber that is located adjacent to the one pressure chamber.

In the light of the above, the assignee of the present application proposed a droplet ejecting apparatus in which the crosstalk can be suppressed without increasing the number of individual electrodes, namely, without increasing the number of signal lines, even when the pressure chambers are formed at a high density. The proposed droplet ejecting apparatus includes: (a) a droplet ejecting head including a cavity unit in which a plurality of pressure chambers are formed regularly and a piezoelectric actuator joined to the cavity unit for permitting a liquid in each pressure chamber to be selectively ejected; and (b) a voltage application device for applying a voltage to the piezoelectric actuator. The piezoelectric actuator includes: (i) first active portions each corresponding to a central portion of a corresponding one of the pressure chambers; (ii) second active portions each corresponding to an outer peripheral portion of the corresponding one of the pressure chambers that is located more outside than the central portion; (iii) individual electrodes each extending over both of a first region corresponding to one of the first active portions and a second region corresponding to the second active portion provided for one pressure chamber; and (iv) a first constant potential electrode disposed in the first region and a second constant potential electrode disposed in the second region.

A further study revealed the following. Where the first and second constant potential electrodes overlap each other, as seen in a superposition direction in which the cavity unit and the piezoelectric actuator are superposed, at portions of the actuator not corresponding to the pressure chambers, foreign substances tend to get caught to thereby cause cracks, and a short circuit accordingly occurs between a power source and the ground, resulting in a decrease of the withstand pressure. Further, the actuator needs to bear a large stress because the actuator suffers from a stress due to deformation of piezoelectric layers thereof. In these instances, there is a risk of breakage of the actuator. In the light of the above, each of the first and second constant potential electrodes is formed to have a comb-like shape, so as to avoid overlapping each other. That is, each of the first and second constant potential electrodes has the comb-like shape so as not to overlap each other, as seen in the superposition direction, at the portions where the foreign substances may get caught.

In the thus constructed droplet ejecting apparatus, each individual electrode needs to have a connection portion (a lead portion) through which the individual electrode is connected to a signal line (a wire). The connection portion is formed at the portions except for portions corresponding to the pressure chambers. Accordingly, the connection portion needs to be provided so as to overlap the first constant potential electrode or the second constant potential electrode each as an internal electrode, as seen in the superposition direction. The connection portion is provided with a bump formed of silver (Ag) for easy connection with a connection terminal of a flexible wiring board through which a drive signal is inputted. In the meantime, the first and second constant potential electrodes each as the internal electrode are formed of a mixture of silver (Ag) and Palladium (Pd). In general, silver (Ag) tends to suffer from migration. However, on the basis of the observation that there are no concerns of migration as long as the potential of the internal electrode that overlaps the connection portion is kept higher than the potential of the individual electrode, the connection portion was conventionally formed so as to overlap, as seen in the superposition direction indicated by "Z" (FIG. 8) in which the cavity unit and the piezoelectric actuator are superposed on each other, the first constant potential electrode to which is given a potential higher than or equal to the potential of the individual electrode.

More specifically, the piezoelectric actuator was conventionally structured as shown in FIGS. 7A, 7B, and 8. In the actuator generally indicated at 112, individual electrodes 121 are formed as a first layer on the upper surface of a piezoelectric-material layer 112*a* of the piezoelectric actuator 112 so as to respectively correspond to first active portions S11 for respective pressure chambers 114Aa, as seen in the superposition direction Z. First constant potential electrodes 122 are formed as a second layer on the lower surface of the piezoelectric-material layer 112*a*. Each first constant potential electrode 122 has a comb-like shape constituted by first branch portions 122A corresponding to the respective first active portions S11 and a first trunk portion (i.e., connecting portion) 122B to which the first branch portions 122A are connected and which extends in a direction X in which each nozzle row extends (hereinafter referred to as "the nozzle-row direction X" where appropriate). Second constant potential electrodes 123 are formed as a third layer on the lower surface of the piezoelectric-material layer 112*b*. Each second constant potential electrode 123 has a comb-like shape constituted by second branch portions 123A corresponding to the respective second active portions S12 and a second trunk portion (i.e., connecting portion) 123B to which the second branch portions 123A are connected and which extends in the nozzle-row direction X. The first trunk portion 122B of each of the first constant potential electrodes 122 and the second trunk portion 123B of each of the second constant potential electrodes 123 are arranged alternately in a direction Y orthogonal to the nozzle-row direction X. Connection portions 121*a* of the respective individual electrodes 121 that are connected to respective connection terminals of a flexible wiring board are provided so as to overlap the first trunk portions 122B of the respective first constant potential electrodes 122 as seen in the superposition direction Z. The cavity unit 111 is constituted by: a stacked body 114 in which a nozzle plate (not shown) is disposed at its underside; and a top plate 115 bonded to the upside of the stacked body 114. It is noted that arrows in FIG. 8 indicate a polarization direction.

SUMMARY OF THE INVENTION

In the actuator constructed as described above, when the piezoelectric actuator is driven, deformation of portions of the actuator sandwiched between the connection portions 121 a of the individual electrodes 121 and the first trunk portions 122B of the first constant potential electrodes 122 hinders deformation of the pressure chambers, undesirably causing deformation loss of the pressure chambers.

Explanation will be made with reference to FIGS. 9A and 9B. In FIGS. 9A and 9B, "WI" indicates a pressure-chamber region while "W2" indicates a columnar-portion region in which the connection portion 121 a of the individual electrode 121 overlap the first trunk portion 122B of the first constant potential electrode 122, as seen in the superposition direction Z.

When a second constant potential is given to the individual electrode 121, the voltage is applied to a portion of the actuator 112 sandwiched between the individual electrode 121 and the first constant potential electrode 122, and the actuator 112 deforms so as to protrude into the pressure chamber 114Aa, as shown in FIG. 9A. On this occasion, the voltage is also applied to a portion sandwiched between the connection portion 121*a* and the first trunk portion 122B. Since this portion is bound or restrained by a columnar portion 114Ac located between adjacent two pressure chambers 114Aa, the actuator 112 deforms so as to pull up or lift up the second active portion, thereby hindering deformation of the pressure chamber by the first active portion. On the other hand, when a first constant potential is given to the individual electrode 121, the voltage is not applied to the portion sandwiched between the individual electrode 121 and the first trunk portion 122B. Accordingly, first active portion does not deform (FIG. 9B). Further, since the voltage is not applied to the portion sandwiched between the connection portion 121*a* and the first trunk portion 122B, the pull-up effect of pulling up the second active portion is not influenced.

It is an object of the invention to provide a droplet ejecting apparatus in which the deformation loss of pressure chambers is reduced so as to increase the deformation efficiency utilizing connection portions of individual electrodes, owing to a suitable layout of the connection portions.

The above-indicated object may be attained according to a principle of the invention, which provides a droplet ejecting apparatus comprising:

a droplet ejecting head including a cavity unit in which a plurality of pressure chambers are arranged and a piezoelectric actuator which is superposed on the cavity unit and which permits a liquid in the pressure chambers to be ejected therefrom as a droplet;

a voltage application device configured to apply a voltage to the piezoelectric actuator;

wherein the piezoelectric actuator includes:

(a) a plurality of first active portions each of which is provided so as to correspond to a central portion of a corresponding one of the pressure chambers;

(b) a plurality of second active portions each of which corresponds to a portion of the cavity unit that is located outside of the central portion of the corresponding one of the pressure chambers;

(c) a first potential electrode which has a comb-like shape and which includes a plurality of first branch portions provided so as to respectively correspond to the plurality of first active portions and a first trunk portion that connects the plurality of first branch portions, the first potential electrode being constantly given a first potential by the voltage application device;

(d) a second potential electrode which has a comb-like shape and which includes a plurality of second branch portions provided so as to respectively correspond to the plurality of second active portions and a second trunk portion that connects the plurality of second branch portions, the second potential electrode being constantly given a second potential that is different from the first potential by the voltage application device; and (e) a plurality of individual electrodes each of which is provided so as to correspond to one of the plurality of first active portions and at least one of the plurality of second active portions and to which the first potential and the second potential are selectively given at a connection portion thereof by the voltage application device, wherein the connection portion of each of the plurality of individual electrodes is disposed so as to overlap the second trunk portion of the second potential electrode as seen in a superposition direction in which the cavity unit and the actuator are superposed.

BRIEF DESCRIPTION OF THE DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

There will be hereinafter described one embodiment of the invention with reference to the drawings.

Figure 1A:
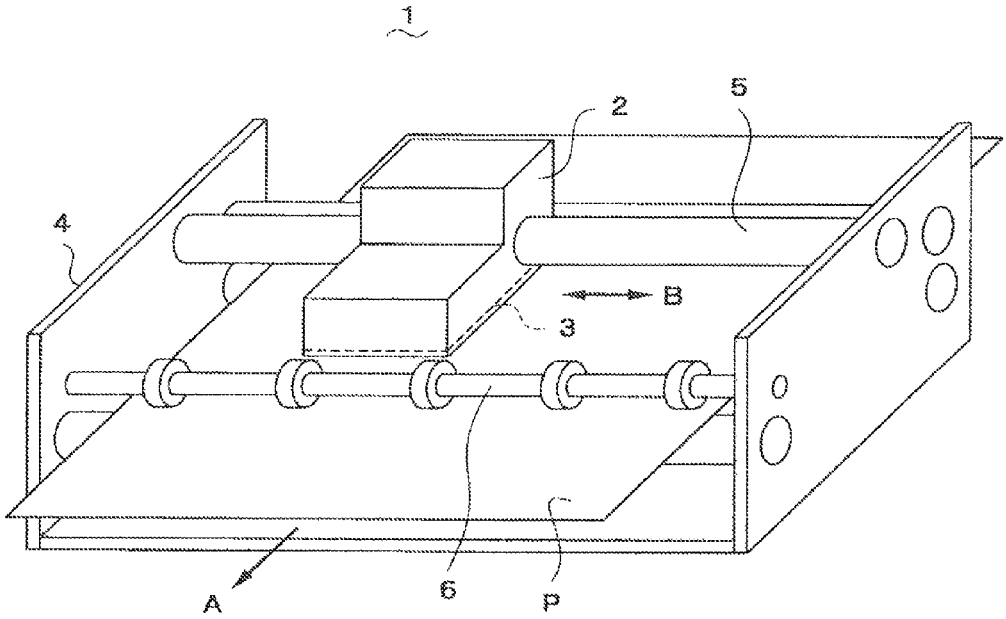
FIG. 1A is a view schematically showing a structure of an ink-jet printer as a droplet ejecting apparatus according to one embodiment of the invention and FIG. 1B is an explanatory view showing a relationship of a cavity unit, a piezoelectric actuator, and a flexible wiring board (COP) according to the embodiment of the invention.

As shown in FIG. 1A, an ink-jet printer generally indicated at 1, as a droplet ejecting apparatus according to one embodiment of the invention, has an ink-jet head 3 as a droplet ejecting head for performing a recording operation on a recording sheet P as a recording medium. The ink-jet head 3 is disposed on the lower surface of a carriage 2 on which an ink cartridge (not shown) is mounted. The carriage 2 is supported by a carriage shaft 5 and a guide plate (not shown) provided in a printer frame 4 and is configured to reciprocate in a direction B orthogonal to a sheet conveyance direction A in which the recording sheet P is conveyed. The recording sheet P conveyed from a sheet supply portion (not shown) in the sheet conveyance direction A is introduced into a space between a platen roller (not shown) and the ink-jet head 3, and a suitable recording operation is performed on the recording sheet P with ink ejected from the ink jet head 3 toward the sheet P. Thereafter, the sheet P is discharged by discharge rollers 6.

Figure 1B:
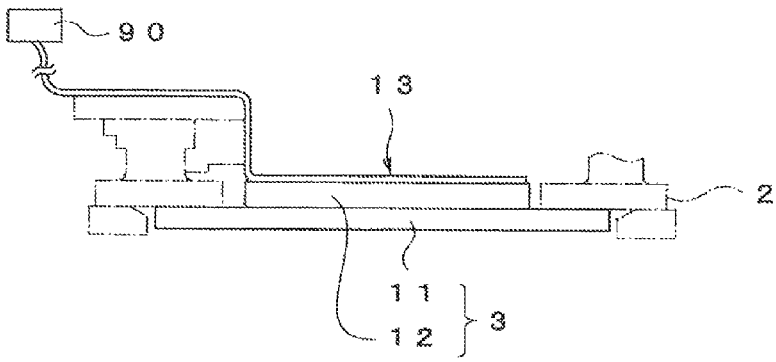

As shown in FIG. 1B, the ink-jet head 3 includes: a cavity unit 11 in which a plurality of pressure chambers 14Aa are regularly formed; and a piezoelectric actuator 12 bonded to the upside of the cavity unit 11 for permitting ink in each pressure chamber 14Aa to be selectively ejected. A flexible wiring board 13 as signal lines is provided on the upper surface of the piezoelectric actuator 12 for supplying drive signals.

Figure 2A:
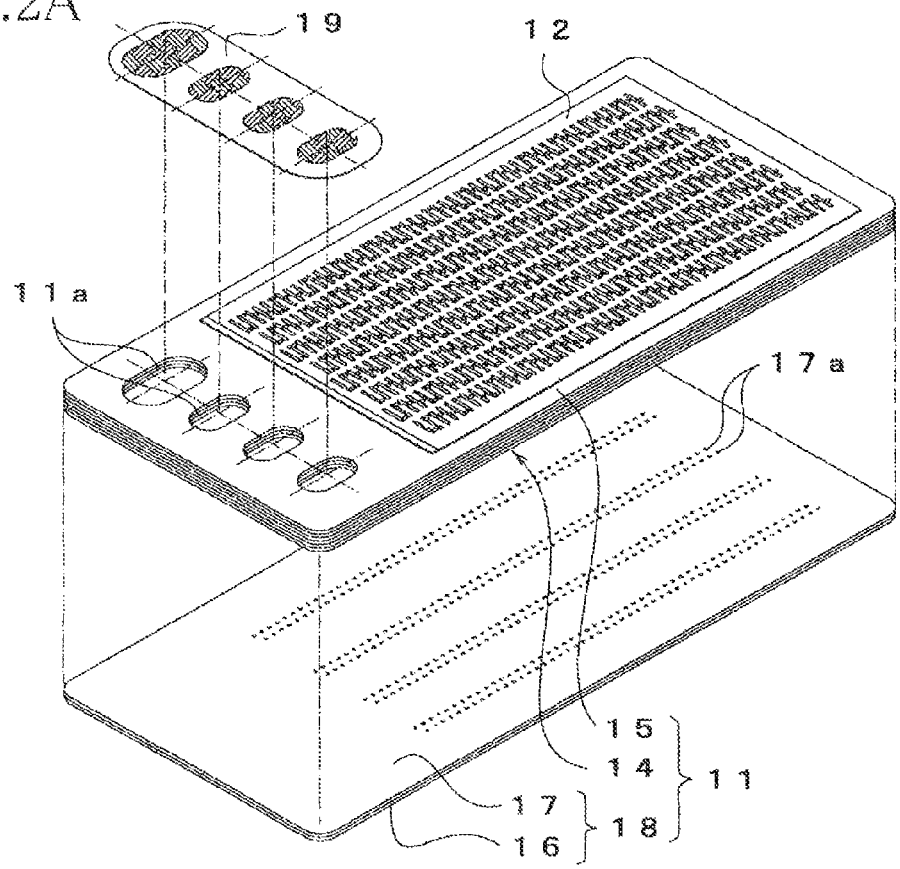
FIGS. 2A and 2B are perspective views showing a state in which the piezoelectric actuator is bonded to the upside of the cavity unit.
Figure 2B:
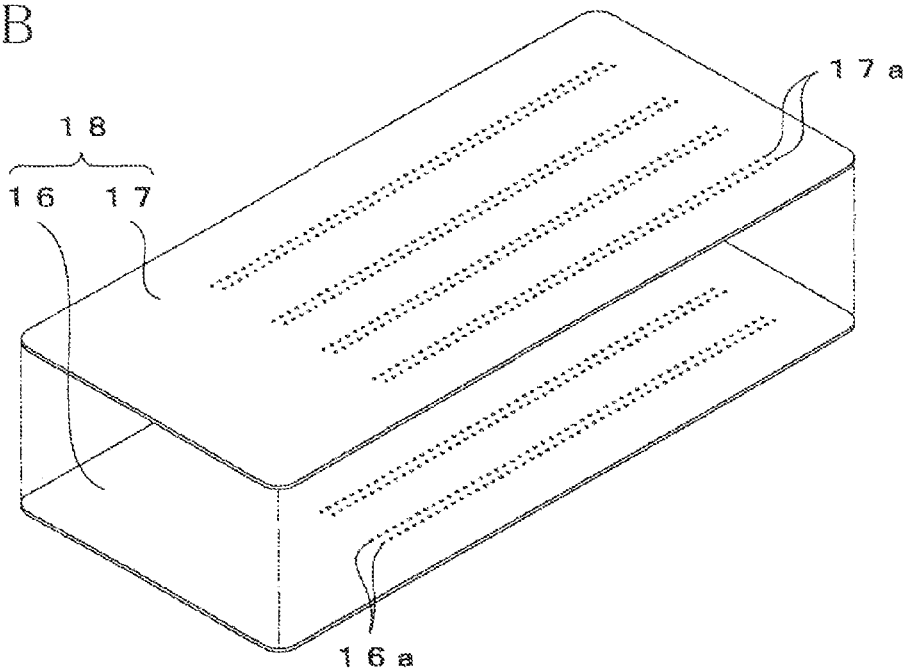

As shown in FIG. 2, the cavity unit 11 has a stacked body 14 constituted by a plurality of plate members. A top plate 15 is provided on the upside of the stacked body 14 while a plate assembly 18 is bonded integrally to the underside of the stacked body 14. The plate assembly 18 is constituted by a nozzle plate 16 having nozzle holes 16*a* and a spacer plate 17 bonded to the nozzle plate 16 and having through-holes 17*a* formed so as to correspond to the nozzle holes 16*a*. On the upside of the top plate 15, the piezoelectric actuator 12 is bonded for permitting the ink as a liquid in each pressure chamber 14Aa to be selectively ejected. A filter 19 for catching dust and the like contained in the ink is disposed on openings 11 a of the cavity unit 11. The nozzle plate 16 is a plate formed of synthetic resin such as polyimide resin in which the nozzle holes 16*a* are formed so as to correspond to the respective pressure chambers 14Aa of a cavity plate 14A. The nozzle plate 16 may be a metal plate.

Figure 3:
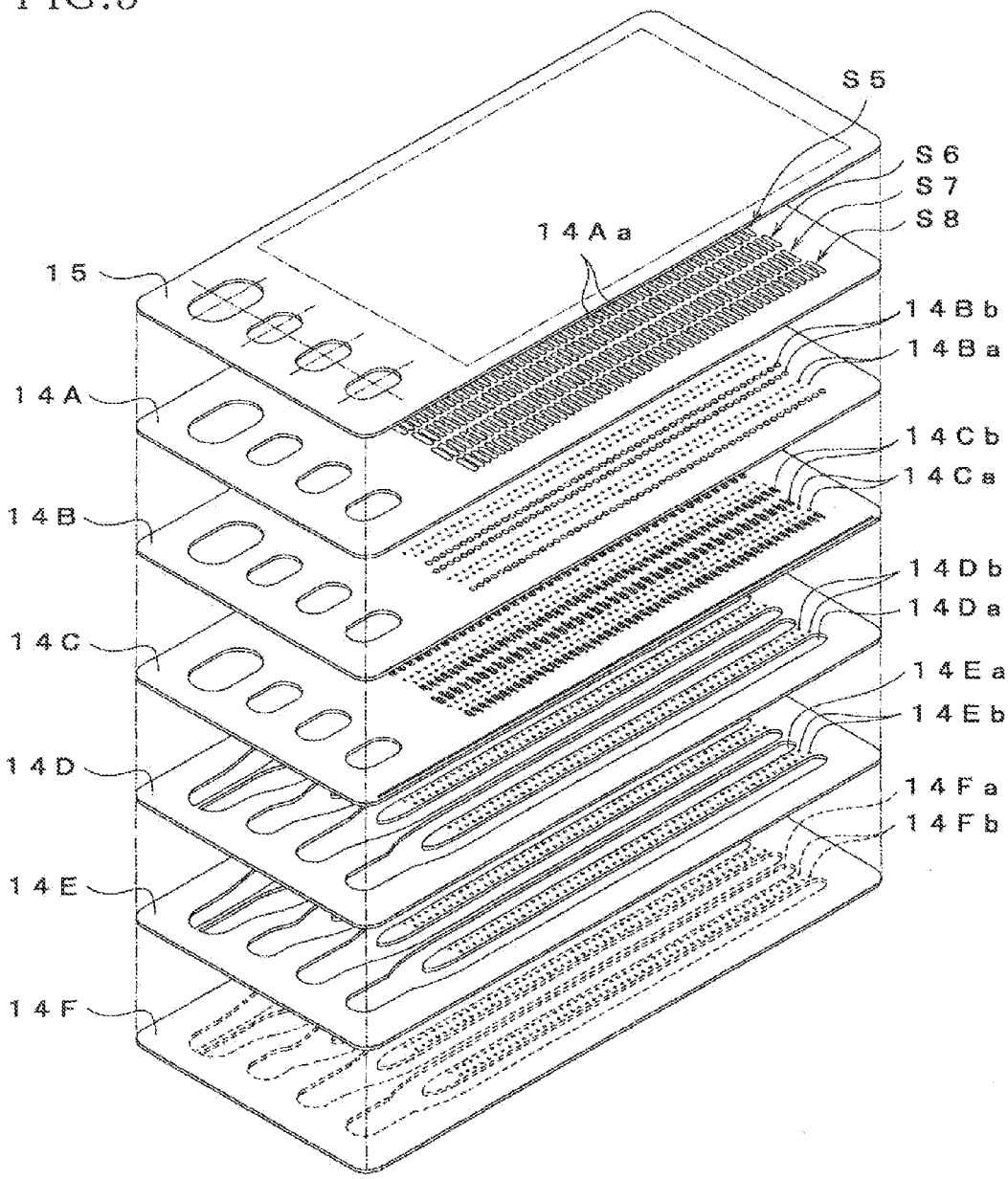
FIG. 3 is a view in which the cavity unit is disassembled into plates each as a constituent element thereof, the view showing each of the plates, together with a top plate.

As shown in FIG. 3, the stacked body 14 includes, as seen from the top thereof, the cavity plate 14A, a base plate 14B, an aperture plate 14C, two manifold plate 14D, 14E, and a damper plate 14F, which are superposed on and bonded to one another. These six plates 14A-14F are stacked so as to be positioned relative to one another such that individual ink channels are formed for the respective nozzle holes 16*a*. The cavity plate 14A is a metal plate in which openings that function as the pressure chambers 14Aa are regularly formed so as to correspond to nozzle rows. The base plate 14B is a metal plate in which there are formed: communication holes 14Ba for ink flows from manifolds 14Da, 14Ea (as common ink chambers) to the pressure chambers 14Aa; and communication holes 14Bb for ink flows from the pressure chambers 14Aa to the nozzle holes 16*a*. On the upper surface of the aperture plate 14C which is a metal plate, communication passages for allowing communication between the pressure chambers 14Aa and the manifolds 14Da, 14Ea are formed as recessed passages. Further, in the aperture plate 14C, there are formed: communication holes 14Ca for ink flows from the manifolds 14Da, 14Ea (as the common ink chambers) to the pressure chambers 14Aa; and communication holes 14Cb for ink flows from the pressure chambers 14Aa to the nozzle holes 16*a*. The manifold plates 14D, 14E are metal plates in which there are formed, in addition to the manifolds 14Da, 14Ea, communication holes 14Db, 14Eb, respectively, for ink flows from the pressure chambers 14Aa to the nozzle holes 16*a*. The damper plate 14F is a metal plate in which there are formed: damper chambers 14Fa that are formed on the lower surface of the damper plate 14F as recessed portions; and communication holes 14Fb for allowing communication between the pressure chambers 14Aa and the nozzle holes 16*a*.

As described above, the cavity unit 11 is constructed so as to include the plurality of nozzle holes 16*a*, the plurality of pressure chambers 14Aa communicating with the respective nozzle holes 16*a*, and the manifolds 14Da, 14Ea for temporarily storing the ink to be supplied to the pressure chambers 14Aa.

Figure 4A:
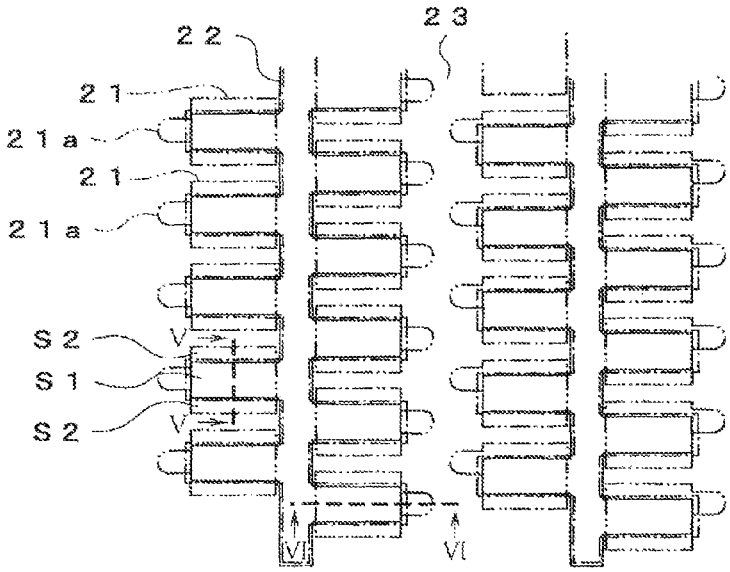
FIG. 4A is an explanatory view showing a position relationship of respective electrodes in the piezoelectric actuator as seen in a superposition direction in which the cavity unit and the piezoelectric actuator are superposed and FIG. 4B is an explanatory view showing a layout of each electrode in each piezoelectric-material layer of the piezoelectric actuator.
Figure 4B:
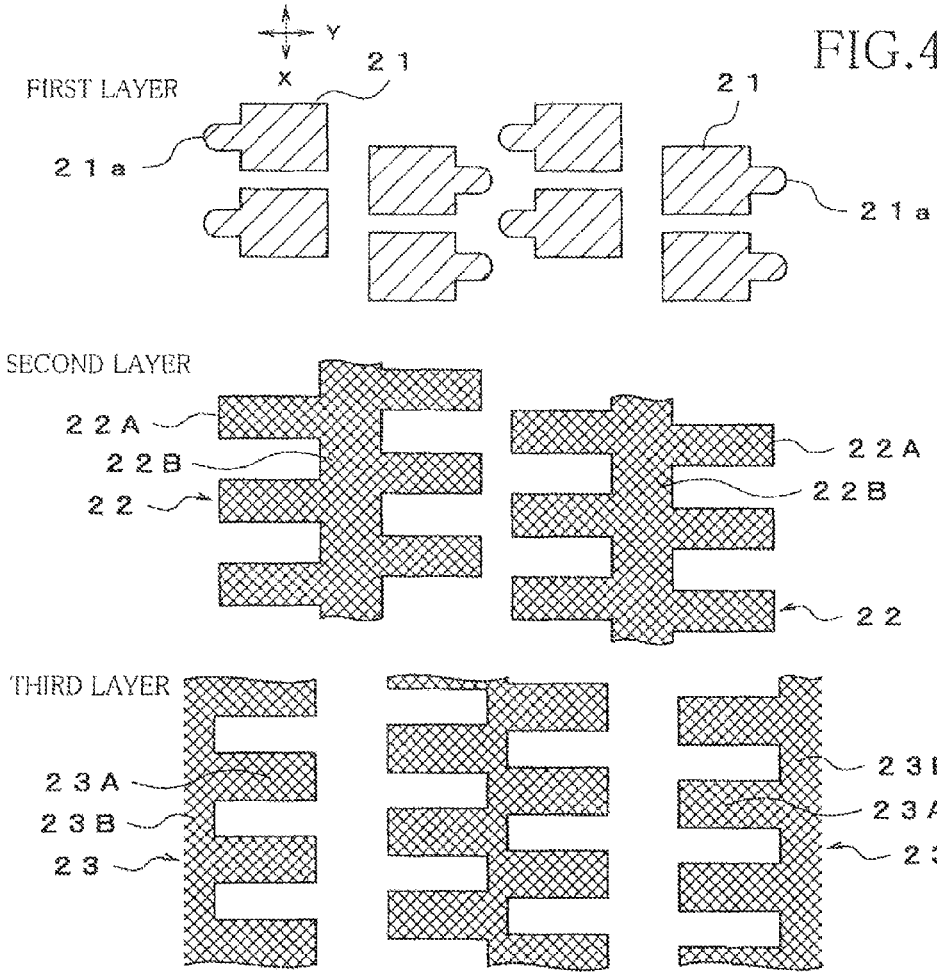
Figure 5:
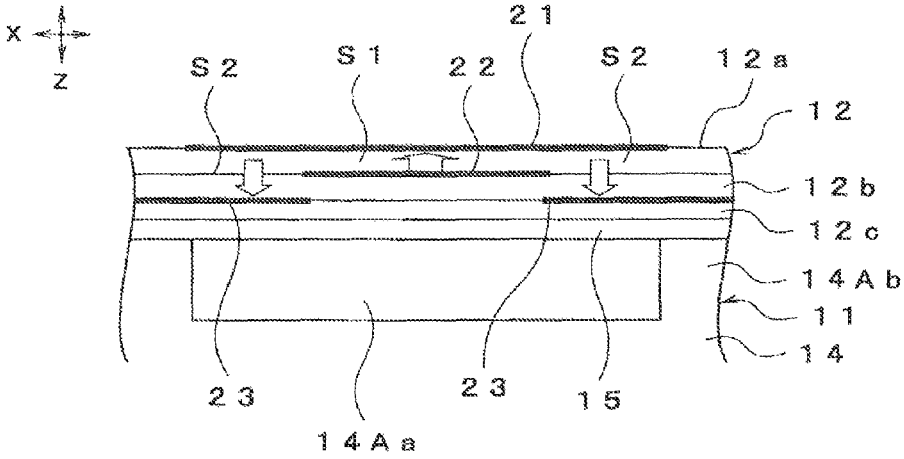
FIG. 5 is a cross sectional-view taken along line V-V in FIG. 4A.
Figure 6A:
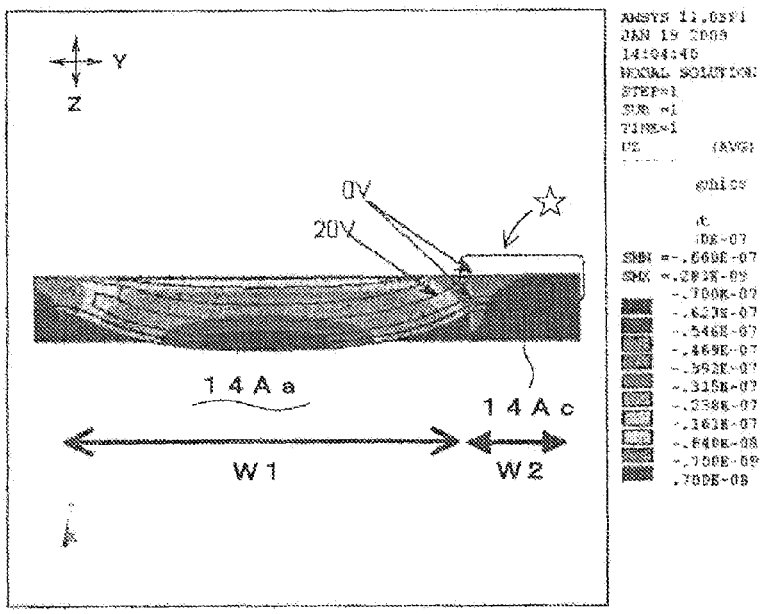
FIGS. 6A and 6B are views each showing a deformation state of the piezoelectric actuator taken along line VI-VI in FIG. 4A, a drive voltage being applied to a first active portion in FIG. 6A while the drive voltage is not applied to the first active portion in FIG. 6B.
Figure 6B:
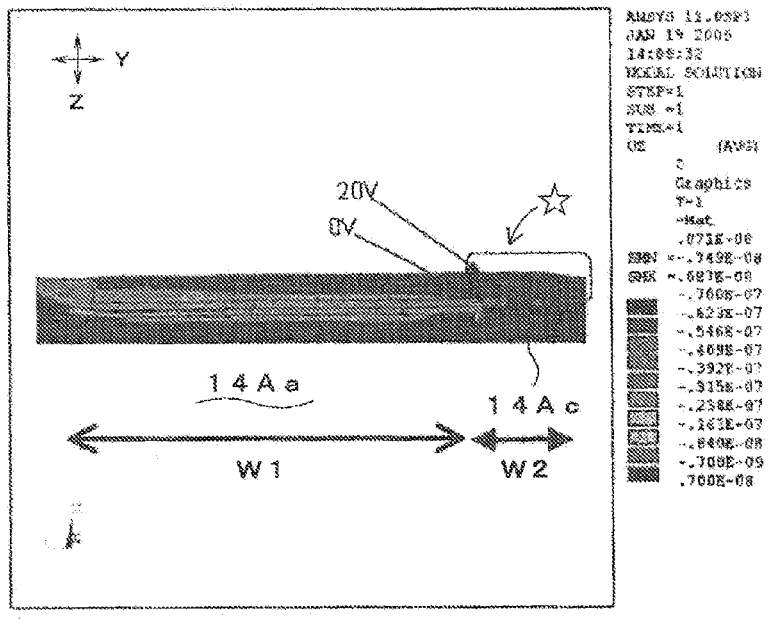

The piezoelectric actuator 12 has a plurality of piezoelectric-material layers 12*a*, 12*b*, and 12*c* which are stacked on each other, as shown in FIGS. 4-6. Each of the piezoelectric-material layers 12*a*-12*c* is a piezoelectric sheet formed of a ceramic material of lead zirconate titanate (PZT) having ferroelectricity and is polarized in the thickness direction thereof. It is noted that each of arrows in FIG. 5 indicates a polarization direction. In FIGS. 6A and 6B, "W1" indicates a pressure-chamber region while "W2" indicates a columnar-portion region in which a connection portion 21*a* of an individual electrode 21 overlaps a second trunk portion 23B of a second constant potential electrode 23 (which will be explained), as seen in a superposition direction Z in which the cavity unit 11 and the piezoelectric actuators 12 are superposed on each other.

The piezoelectric-material layer 12*a* and the piezoelectric-material layer 12*b* are provided on the upper side and the lower side of first constant potential electrodes (first potential electrodes) 22, respectively, which are disposed so as to be sandwiched between the two layers 12*a*, 12*b*. Individual electrodes 21 provided for the respective pressure chambers 14Aa are disposed on the upper surface of the piezoelectric-material layer 12*a*. Second constant potential electrodes (second potential electrodes) 23 are disposed on the lower surface of the piezoelectric-material layer 12*b*. In other words, the piezoelectric actuator 12 includes a plurality of piezoelectric-material layers 12*a*-12*c* which are stacked on each other. Each first constant potential electrode 22 is disposed so as to be sandwiched between two 12*a*, 12*b* of the plurality of piezoelectric-material layers. Each second constant potential electrode 23 is disposed such that the second constant potential electrode 23 cooperates with the first constant potential electrode 22 to sandwich one 12*b* of the two piezoelectric-material layers 12*a*, 12*b* therebetween. Each of the individual electrodes 21 is disposed such that the individual electrode 21 cooperates with the first constant potential electrode 22 to sandwich the other 12*a* of the two piezoelectric-material layers 12*a*, 12*b* therebetween. Each of these electrodes 21, 22, 23 is formed of a metal material of Ag—Pd.

The piezoelectric actuator 12 includes, as seen in the superposition direction Z in which the cavity unit 11 and the actuator 12 are superposed on each other, first active portions Si in which portions of the piezoelectric-material layer 12*a* are sandwiched between the individual electrodes 21 and the first constant potential electrode 22, so as to correspond to central portions of the respective pressure chambers 14Aa, and second active portions S2 in which portions of the piezoelectric-material layers 12*a*, 12*b* are sandwiched between the individual electrodes 21 and the second constant potential electrodes 23, so as to correspond to outer peripheral sides, namely, left and right sides, of the central portion of each pressure chamber 14Aa. Each of the second active portions S2 is provided so as to correspond to a portion of the cavity unit 11 that is located outside of the central portion of the corresponding pressure chamber 14Aa. Accordingly, each individual electrode 21 is formed so as to extend over both of the first active portion Si for the corresponding pressure chamber 14Aa and two second active portions S2 located on the left and right sides (the outer peripheral sides) of the central portion of the pressure chamber 14Aa. Here, the central portion of each pressure chamber 14Aa is a central portion thereof in a nozzle-row direction X in which the nozzle holes 16*a* are arranged, i.e., in which each nozzle row extends.

More specifically, each second active portion S2 is formed so as to occupy both of a region corresponding to a columnar portion (a girder portion, a beam portion) 14Ab as a wall partitioning two pressure chambers 14Aa which are adjacent to each other in the nozzle-row direction X and a region corresponding to a portion that is located inside of the outer periphery of the pressure chamber 14Aa nearer to the central portion. In other words, the second branch portion 23A of each second constant potential electrode 23 extends over not only the region corresponding to the columnar portion 14Ab, but also a region corresponding to one side portion of one pressure chamber 14Aa and a region corresponding to one side portion of another pressure chamber 14Aa, which two pressure chambers are adjacent to each other in the nozzle-row direction X. In other words, one second branch portion 23A is shared for any two pressure chambers 14Aa that are adjacent in the nozzle-row direction X.

Each individual electrode 21 has the connection portion 21 a to which a connection terminal (not shown) of the flexible wiring board 13 as a wiring member is connected. The driver IC 90 for supplying drive signals is electrically connected to the flexible wiring board 13 as the signal lines, as shown in FIG. 1B. On each connection portion 21*a*, there is formed a bump (Ag) through which the connection terminal of the flexible wiring board 13 is connected.

The driver IC 90 and the flexible wiring board 13 constitute a voltage application device for applying a drive voltage to the first active portions S1 and the second active portions S2 of the piezoelectric actuator 12. More specifically, to each of the individual electrodes 21, there are selectively given, through the flexible wiring board 13, a first constant potential, i.e., a first potential, (a positive constant potential, e.g., 20V, in the present embodiment) and a second constant potential, i.e., a second potential, lower than the first constant potential (the ground potential in the present embodiment), for changing the volume of each pressure chamber 14Aa. Further, the first constant potential electrodes 22 are constantly given the first constant potential (the positive constant potential, e.g., 20V) while the second constant potential electrodes 23 are constantly given the second constant potential (the ground potential).

According to the arrangement described above, when the first constant potential is given to the individual electrodes 21, the voltage is applied to the second active portions S2 whereas the voltage is not applied to the first active portions S1. On the other hand, when the second constant potential is given to the individual electrodes 21, the voltage is applied to the first active portions S1 whereas the voltage is not applied to the second active portions S2.

As described above, the piezoelectric actuator 21 has the individual electrodes 21 corresponding to the respective pressure chambers 14Aa and is configured to permit the ink to be ejected from the nozzle holes 16*a* as a result of changing the volume of the pressure chambers 14Aa as described below, by selectively giving, as the drive signal, the first constant potential (the positive constant potential) and the second constant potential (the ground potential) to the individual electrodes 21.

With reference to FIGS. 4A and 4B, there will be next explained a specific layout of the electrodes 21, 22, 23 as seen in the superposition direction Z in which the cavity unit 11 and the piezoelectric actuator 12 are superposed on each other.

The individual electrodes 21 are formed as a first layer on the upper-surface side of the piezoelectric-material layer 12*a* at a constant pitch in the nozzle-row direction X so as to correspond to the respective pressure chambers 14Aa. One individual electrode 21 belonging to one nozzle row is formed so as to be shifted, in the nozzle-row direction X, from another individual electrode 21 belonging to another nozzle row that is adjacent to that one nozzle row in the direction Y orthogonal to the nozzle-row direction X, by a distance corresponding to half a pitch. Between two nozzle rows adjacent to each other in the direction Y and on one side of each individual electrode 21 corresponding to the second trunk portion 23B of the second constant potential electrode 23, the connection portions 21 a of the respective individual electrodes 21 to which the respective connection terminals (not shown) of the flexible wiring board 13 are connected are formed in a zigzag fashion as shown in FIGS. 4A and 4B.

Each first constant potential electrode 22 formed as a second layer on the lower-surface side of the piezoelectric-material layer 12*a* includes: first branch portions 22A which are arranged at a constant pitch in the nozzle-row direction X so as to correspond to the first active portions S 1 for the respective pressure chambers 14Aa; and a first trunk portion 22B which extends in the nozzle-row direction X and to which one end of each of the first branch portions 22A is connected. Thus, the first constant potential electrode 22 has a comb-like shape.

Each second constant potential electrode 23 formed as a third layer on the lower-surface side of the piezoelectric-material layer 12*b* includes: second branch portions 23A which are arranged at a constant pitch in the nozzle-row direction X so as to correspond to the second active portions S2 for the plurality of pressure chambers 14Aa; and the second trunk portion 23B which extends in the nozzle-row direction X and to which one end of each of the second branch portions 23A is connected. Thus, like the first constant potential electrode 22, the second constant potential electrode 23 has a comb-like shape.

More specifically, a pair of second active portions S2 are provided for each of the plurality of pressure chambers 14Aa, such that the pair of second active portions S2 sandwich, therebetween, the central portion of the corresponding pressure chamber 14Aa in a direction of arrangement of the pressure chambers 14Aa (in the nozzle-row direction X) in which the pressure chambers 14Aa are arranged. Further, each of the second branch portions 23B of the second constant potential electrode 23, from which are excluded two of the second branch portions 23B that are located at opposite ends in the direction of arrangement of the pressure chambers 14Aa, is disposed in a region that extends over both of one of the pair of second active portions S2 provided so as to correspond to one of adjacent two of the pressure chambers 14Aa and one of the pair of second active portions S2 provided so as to correspond to the other of the adjacent two of the pressure chambers 14Aa. Moreover, each of the first branch portions 22B of the first constant potential electrode 22 and each of the second branch portions 23B of the second constant potential electrode 23 are alternately arranged in the direction of arrangement of the pressure chambers 14Aa, and the first trunk portion 22B of each first constant potential electrode 22 and the second trunk portion 23B of each second constant potential electrode 23 are disposed on one and the other sides of the pressure chambers 14Aa with the pressure chambers 14Aa interposed therebetween in a direction orthogonal to the direction of arrangement of the pressure chambers 14Aa.

As described above, when viewed in the superposition direction Z in which the cavity unit 11 and the piezoelectric actuator 12 are superposed on each other, both of the first and second constant potential electrodes 22, 23 have the comb-like shape, and the first branch portions 22A and the second branch portions 23A are alternately arranged in the nozzle-row direction X while the first trunk portions 22B of the respective first constant potential electrodes 22 and the second trunk portions 23B of the respective second constant potential electrodes 23 are alternately arranged in the direction Y orthogonal to the nozzle-row direction X. According to the arrangement, each first constant potential electrode 22 and each second constant potential electrode 23 do not overlap each other. Therefore, at the portions where the foreign substances may get caught, the first and second constant potential electrodes 22, 23 do not overlap as seen in the superposition direction Z, thereby obviating the breakage of the actuator 12 due to the foreign substances that may get caught as described above.

The connection portions 21 a of the respective individual electrodes 21 overlap the second trunk portion 23B of each second constant potential electrode 23 as seen in the superposition direction Z. In other words, the connection portions 21*a* of the respective individual electrodes 21 doe not overlap the first constant potential electrodes 22 as seen in the superposition direction Z.

The first active portions S1 are polarized in the same direction as the direction of the voltage applied thereto when the first active portions S1 deform by giving the second constant potential to the individual electrodes 21 and giving the first constant potential to the first constant potential electrodes 22. On the other hand, the second active portions S2 are polarized in the same direction as the direction of the voltage applied thereto when the second active portions S2 deform by giving the first constant potential to the individual electrodes 21 and giving the second constant potential to the second constant potential electrodes 23. That is, the direction of voltage application is the same as the polarization direction. Here, the voltage to be applied between the electrodes during driving is lower than the voltage to be applied during polarization, thereby suppressing deterioration due to repeated voltage application between the electrodes.

Owing to the layout of the electrodes 21, 22, 23 described above, when the voltage application device gives the second constant potential (the ground potential) to the individual electrodes 21, namely, in the standby state, the voltage is applied to the first active portions S1 in the same direction as the polarization direction, and the first active portions S1 expand in the superposition direction Z and contract in the nozzle-row direction X orthogonal to the superposition direction Z by the piezoelectric lateral effect, so that the first active portions S1 deform so as to protrude toward the insides of the pressure chambers 14Aa. In contrast, the top plate 15 does not spontaneously contract because the top plate 15 is not influenced by the electric field. Accordingly, there is caused a difference in strain in a direction perpendicular to the polarization direction between the piezoelectric-material layer 12*c* and the top plate 15 located under the layer 12*c*. Combination of this phenomenon and the fact that the top plate 15 is fixed to the cavity plate 14A causes the piezoelectric-material layer 12*c* and the top plate 15 to deform convexly toward the pressure chambers 14Aa (i.e., the unimorph deformation), and the piezoelectric actuator 12 is placed in the standby state. Thus, the piezoelectric actuator 12 is configured such that, where the second constant potential is given to the individual electrodes 21, the first active portions 51 corresponding to the respective individual electrodes 21 deform so as to expand in the superposition direction Z and contract in a direction orthogonal to the superposition direction Z, so that the volume of the pressure chambers 14Aa respectively corresponding to the individual electrodes 21 is reduced.

On this occasion, since the second active portions S2 are in a non-voltage-application state, the second active portions S2 are placed in a state (a non-deforming state) in which the second active portions S2 do not expand and contract in the superposition direction Z and the nozzle-row direction X and accordingly do not deform. Further, the voltage is not applied to portions of the actuator 12 sandwiched between the connection portions 21*a* of the individual electrodes 21 and the second constant potential electrodes 22 and accordingly do not deform ("W2" in FIG. 6A), so that the protruding deformation of the first active portions S1 toward the insides of the pressure chambers 14Aa is not hindered.

There will be explained an operation when the first constant potential (the positive potential) is initially given to the individual electrodes 21 and subsequently the voltage is applied to the first active portions S1 such that the potential of the individual electrodes 21 returns to the second constant potential (the ground potential), namely, there will be explained an operation in the driving state.

Figure 7A:
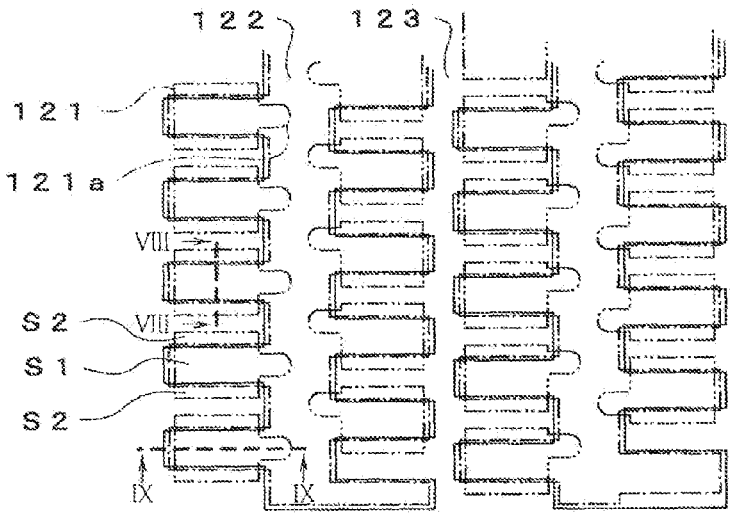
FIG.7A RELATED ART
FIGS. 7A and 7B are views, for a conventional piezoelectric actuator, similar to FIGS. 4A and 4B.
Figure 7B:
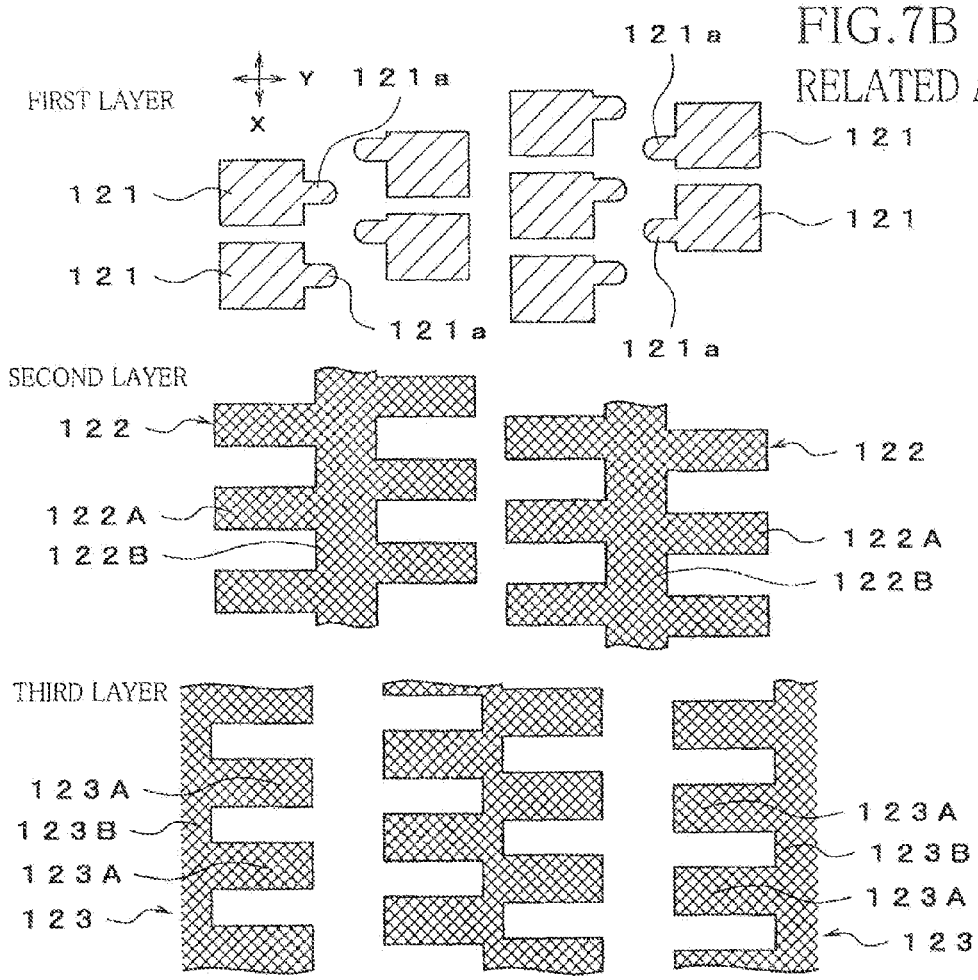
FIG.7B RELATED ART
Figure 8:
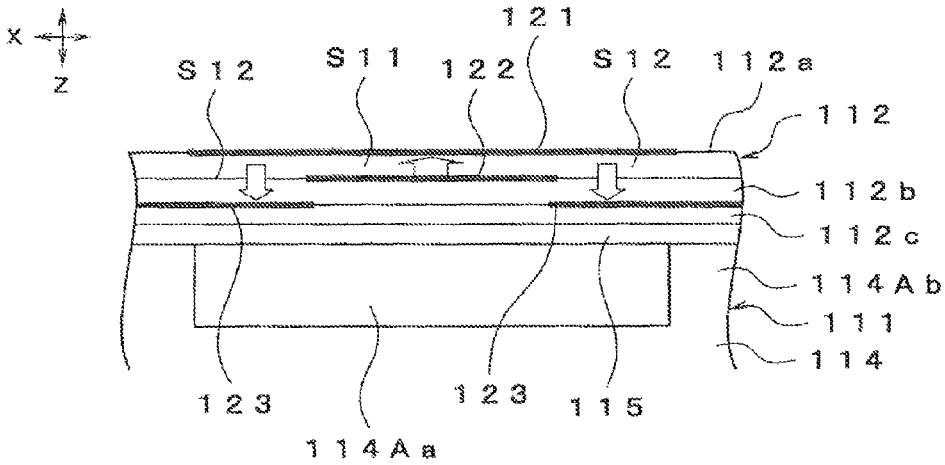
FIG.8 RELATED ART
FIG. 8 is a cross sectional-view taken along line VIII-VIII in FIG. 7A.
Figure 9A:
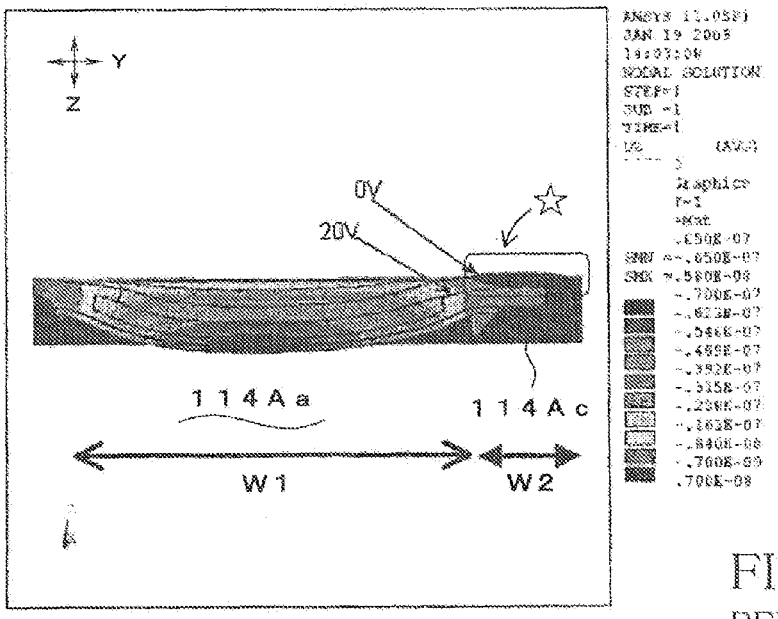
FIG.9A RELATED ART
FIGS. 9A and 9B are views each showing a deformation state of the piezoelectric actuator taken along line IX-IX in FIG. 7A, a drive voltage being applied to a first active portion in FIG. 9A while the drive voltage is not applied to the first active portion in FIG. 9B.
Figure 9B:
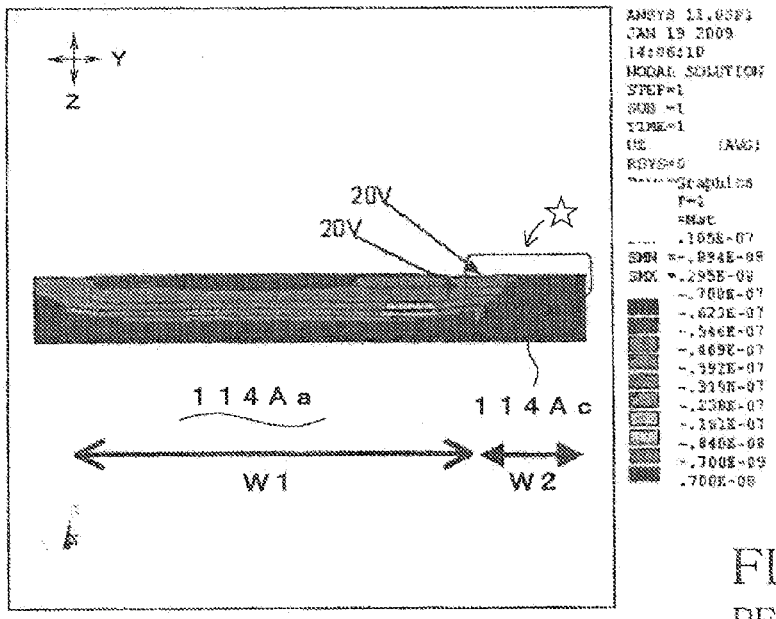
FIG.9B RELATED ART

When the first constant potential (the positive potential) is given to the individual electrodes 21, the first active portions S1 do not expand and contract in the superposition direction Z and the nozzle-row direction X and accordingly do not deform. On this occasion, the second active portions S2 are in a voltage-application state and tend to expand in the superposition direction Z and contract in the nozzle-row direction X orthogonal to the superposition direction Z. Here, the top plate 15 functions as a binding or restraining plate. Accordingly, the second active portions S2 located on the side portions of the corresponding pressure chambers 14Aa in the nozzle-row direction X deform so as to warp in a direction away from the pressure chambers 14Aa. The deformation of the second active portions S2 largely contributes to an increase in the volume changes of the pressure chambers 14Aa and contributes to sucking of a large amount of the ink from the manifolds 14Da, 14Ea into the pressure chambers 14A, i.e., the pull-up effect. Thus, the piezoelectric actuator 12 is configured such that, where the first constant potential is given to the individual electrodes 21, the second active portions S2 corresponding to the individual electrodes 21 deform so as to expand in the superposition direction Z and contract in the direction orthogonal to the superposition direction Z, so that the volume of the pressure chambers 14Aa respectively corresponding to the individual electrodes 21 is increased. On this occasion, the voltage is also applied to the portions sandwiched between the connection portions 21*a* of the individual electrodes 21 and the second constant potential electrode 23 (the second trunk portions 23B). Since the connection portions 21*a* are bound or restrained by the columnar portions 14Ac ("W2" in FIG. 6B), those portions are pulled up, thereby promoting the above-described pull-up effect by the second active portions S2. Consequently, the deformation efficiency of the pressure chambers 14Aa can be enhanced.

Where both of the first and second constant potential electrodes 22, 23 are formed to have the comb-like shape, the deformation loss of the pressure chambers 14Aa can be reduced and the deformation efficiency of the pressure chambers 14Aa can be enhanced simply by disposing the connection portions 21*a* of the individual electrodes 21 so as to overlap the second trunk portions 23B of the second constant potential electrode 23, in place of the first trunk portions 22B of the first constant potential electrode 22, as seen in the superposition direction Z in which the cavity unit 11 and the piezoelectric actuator 12 are superposed on each other. In addition, in the present arrangement described above wherein the connection portions 21*a* of the individual electrodes 21 and the second constant potential electrodes 23 overlap each other with the two piezoelectric-material layers 12*a*, 12*b* interposed therebetween, the distance between the electrodes 21, 23 with the two layers 12*a*, 12*b* interposed between becomes double, as compared with the conventional arrangement wherein the connections portions 121*a* of the individual electrodes 121 and the first constant potential electrodes 122 overlap each other with only the piezoelectric-material layer 12*a* interposed therebetween as shown in FIGS. 7A-7B and 8. Accordingly, the present arrangement offers the advantages that the electrostatic capacity becomes small and the power consumption becomes small. In the driving state in which the voltage is applied between the connection portions 21*a* of the individual electrodes 21 and the second constant potential electrodes 23, the potential of the connection portions 21*a* sometimes becomes higher than the potential of the second constant potential electrodes 23. However, the time period during which the connection portions 21*a* have the higher potential is much shorter than the standby time in which the potential of the connection portions 21*a* and the potential of the second constant potential electrodes 23 are equal to each other. Further, the distance between the connection portions 21*a* and the second constant potential electrodes 23 are made larger. Accordingly, the concerns of migration can be considerably reduced.

Thereafter, when the potential of the individual electrodes 21 returns to the second constant potential (the ground potential), the voltage is applied to the first active portions S1 in the same direction as the polarization direction, and the first active portions S1 expand in the superposition direction Z and contract in the nozzle-row direction X orthogonal to the superposition direction Z by the piezoelectric lateral effect, so that the first active portions S1 deform so as to protrude toward the insides of the pressure chambers 14Aa, as in the above-described standby state. In contrast, the top plate 15 does not spontaneously contract because the top plate 15 is not influenced by the electric field. Accordingly, there is caused a difference in strain in the direction perpendicular to the polarization direction between the piezoelectric-material layer 12*c* and the top plate 15 located under the layer 12*c*. Combination of this phenomenon and the fact that the top plate 15 is fixed to the cavity plate 14A causes the piezoelectric-material layer 12*c* and the top plate 15 to deform convexly toward the pressure chambers 14Aa (i.e., the unimorph deformation). Accordingly, the volume of each pressure chambers 14Aa that was kept large as shown in FIG. 6B becomes smaller as shown in FIG. 6A, so that the pressure of the ink is increased, resulting in ejection of the ink from the nozzle holes 16*a*.

On this occasion, since the second active portions S2 are in the non-voltage-application state, the second active portions S2 return back to the state (the non-deforming state) in which the second active portions S2 do not expand and contract in the superposition direction Z and the nozzle-row direction X and accordingly do not deform. Further, the voltage is not applied to the portions sandwiched between the connection portions 21*a* of the individual electrodes 21 and the second constant potential electrodes 22, and the portions accordingly do not deform, so that the protruding deformation of the first active portions S1 toward the insides of the pressure chambers l4Aa is not hindered.

Thus, when the first active portion S1 corresponding to one pressure chamber 14Aa deforms so as to protrude toward that pressure chamber 14Aa, the second active portions S2 return to the non-deforming state. Accordingly, the influence of the deformation of the first active portion S1 is cancelled by the second active portions S2 and hardly reaches the neighboring pressure chambers 14Aa adjacent to that one pressure chamber 14Aa, thereby suppressing the crosstalk. In other words, the application of the voltage and the non-application of the voltage to the second active portions S2 for one pressure chamber 14Aa are switched so as to prevent propagation, to the neighboring pressure chambers 14Aa, of the influence of the deformation of the first active portion S1 for that one pressure chamber l4Aa due to switching of the application of the voltage and the non-application of the voltage to the first active portion S1.

By the deformation of the first active portions S1 and the second active portions S2 described above, the ink ejecting operations are repeated, and the volume changes of the pressure chambers 14Aa are made large in each ink ejecting operation, thereby enhancing the ejection efficiency while suppressing the crosstalk. In addition, since the connection portions 21*a* of the individual electrodes 21 are disposed so as to overlap the second trunk portions 23B of the second constant potential electrodes 23 as seen in the superposition direction Z in which the cavity unit 11 and the piezoelectric actuator 12 are superposed on each other, the deformation efficiency of the pressure chambers 14Aa can be enhanced.

While the preferred embodiment of the invention has been described by reference to the accompanying drawings, it is to be understood that the invention is not limited to the details of the embodiment, but may be embodied with various changes and modifications, which may occur to those skilled in the art, without departing from the scope of the invention defined in the attached claims.

In the illustrated embodiment, the first constant potential is the positive constant potential and the second constant potential is the ground potential. The second constant potential is not limited to the ground potential since the piezoelectric actuator similarly operates as long as the second constant potential is lower than the first constant potential.

In the illustrated embodiment, each second active portion S2 is disposed so as to extend over both of the region corresponding to the outer peripheral side of the central portion of the corresponding pressure chamber 14Aa in the nozzle-row direction X and the region corresponding to the columnar portion 14Ab. Each second constant potential electrode 23A may be disposed only at the region corresponding to the columnar portion 14Ab irrespective of the region corresponding to the pressure chamber 14Aa, and each second active portion may be disposed so as to be present only at the region corresponding to the columnar portion 14Ab. In this instance, when the second active portion deforms by application of the voltage thereto, the second active portion does not contribute to the increase of the volume of the pressure chamber 14Aa, but the effect of suppressing the crosstalk can be exhibited.

The present invention is not limited to the arrangement in which the droplet ejecting head is the ink-jet head, but may be applied to other droplet ejecting heads configured to apply a colored liquid as micro droplets or to form a wiring pattern by ejecting an electrically conductive liquid, for instance.

In addition to the printing sheet, various other media such as resin and cloth may be used as the recording medium on which the droplet is ejected. In addition to the ink, various other liquids such as a colored liquid and a functional liquid may be used as the liquid to be ejected.

What is claimed is:

1. A droplet ejecting apparatus, comprising:

a droplet ejecting head including a cavity unit in which a plurality of pressure chambers are arranged and a piezoelectric actuator which is superposed on the cavity unit and which permits a liquid in the pressure chambers to be ejected therefrom as a droplet;

a voltage application device configured to apply a voltage to the piezoelectric actuator;

wherein the piezoelectric actuator includes:

(a) a plurality of first active portions each of which is provided so as to correspond to a central portion of a corresponding one of the pressure chambers;

(b) a plurality of second active portions each of which corresponds to a portion of the cavity unit that is located outside of the central portion of the corresponding one of the pressure chambers;

(c) a first potential electrode which has a comb-like shape and which includes a plurality of first branch portions provided so as to respectively correspond to the plurality of first active portions and a first trunk portion that connects the plurality of first branch portions, the first potential electrode being constantly given a first potential by the voltage application device;

(d) a second potential electrode which has a comb-like shape and which includes a plurality of second branch portions provided so as to respectively correspond to the plurality of second active portions and a second trunk portion that connects the plurality of second branch portions, the second potential electrode being constantly given a second potential that is different from the first potential by the voltage application device; and (e) a plurality of individual electrodes each of which is provided so as to correspond to one of the plurality of first active portions and at least one of the plurality of second active portions and to which the first potential and the second potential are selectively given at a connection portion thereof by the voltage application device; and wherein the connection portion of each of the plurality of individual electrodes is disposed so as to overlap the second trunk portion of the second potential electrode as seen in a superposition direction in which the cavity unit and the actuator ate superposed.

2. The droplet ejecting apparatus according to claim 1;

wherein the connection portion of each of the individual electrodes is disposed so as not to overlap the first potential electrode as seen in the superposition direction.

3. The droplet ejecting apparatus according to claim 1;

wherein at least a part of each of the plurality of second active portions is disposed within a region of the corresponding one of the plurality of pressure chambers.

4. The droplet ejecting apparatus according to claim 1;

wherein a pair of the second active portions are provided for each of the plurality of pressure chambers, such that the pair of the second active portions sandwich, therebetween, the central portion in a direction of arrangement of the pressure chambers in which the pressure chambers are arranged; and wherein each of the plurality of second branch portions of the second potential electrode, from which are excluded two of the second branch portions that are located at opposite ends in the direction of arrangement of the pressure chambers, is disposed in a region that extends over both of one of the pair of second active portions provided so as to correspond to one of adjacent two of the plurality of pressure chambers and one of the pair of second active portions provided so as to correspond to the other of the adjacent two of the plurality of pressure chambers.

5. The droplet ejecting apparatus according to claim 1;

wherein each of the individual electrodes includes a main portion disposed at a region that corresponds to a corresponding one of the pressure chambers, and the connection portion of said each of the individual electrodes extends from the main portion so as to be disposed in a region of the cavity unit that does not correspond to the plurality of pressure chambers.

6. The droplet ejecting apparatus according to claim 1; further comprising:

a wiring member that connects the piezoelectric actuator and the voltage application device;

wherein each of the individual electrodes is connected at the connection portion thereof to a corresponding one of terminals of the wiring member.

7. The droplet ejecting apparatus according to claim 1;

wherein each of the first branch portions of the first potential electrode and each of the second branch portions of the second potential electrode ate alternately arranged in a direction of arrangement of the pressure chambers in which We pressure chambers are arranged, and the first trunk portion of the first potential electrode and the second trunk portion of the second potential electrode are disposed on one and the other sides of the pressure chambers with the pressure chambers interposed therebetween in a direction orthogonal to the direction of arrangement of the pressure chambers.

8. The droplet ejecting apparatus according to claim l;

wherein the first potential electrode and the second potential electrode are disposed so as not to overlap each other as seen in the superposition direction.

9. The droplet ejecting apparatus according to claim 1;

wherein the second potential is lower than the first potential.

10. The droplet ejecting apparatus according to claim 9:

wherein the first potential is a positive potential while the second potential is a ground potential.

11. The droplet ejecting apparatus according to claim 1:

wherein the piezoelectric actuator is configured such that where the second potential is given to one of the individual electrodes, one of the first active portions corresponding to the one of the individual electrodes deforms so as to expand in the superposition direction and contract in a direction orthogonal to the superposition direction, so that a volume of one of the pressure chambers corresponding to the one of the individual electrodes is reduced; and wherein the piezoelectric actuator is configured such that, where the first potential is given to the one of the individual electrodes, one of the second active portions corresponding to the one of the individual electrodes deforms so as to expand in the superposition direction and contract in the direction orthogonal to the superposition direction, so that the volume of the one of the pressure chambers corresponding to the one of the individual electrodes is increased.

12. The droplet ejecting apparatus according to claim 1;

wherein the piezoelectric actuator includes a plurality of piezoelectric-material layers which are stacked on each other; and wherein the first potential electrode is disposed so as to be sand sandwiched between two of the plurality of piezoelectric--material layers, the. second potential electrode is disposed such that the second potential electrode cooperates with the first potential electrode to sandwich one of the two piezoelectric-material layers therebetween, and each of the individual electrodes is disposed such that said each of the individual electrodes cooperates with the first potential electrode to sandwich the other of the two piezoelectric-material layers therebetween.

* * * * *